United States Patent [19]

White

[11] Patent Number: 4,932,691

[45] Date of Patent: Jun. 12, 1990

[54] OPERATING MECHANISM FOR CLOSURE FASTENING ELEMENTS

[75] Inventor: Paul S. White, Barnsley, England

[73] Assignee: Crompton Limited, Lancanshire, England

[21] Appl. No.: 305,788

[22] Filed: Feb. 2, 1989

[30] Foreign Application Priority Data

Feb. 4, 1988 [GB] United Kingdom ..... 8802461
Feb. 24, 1988 [GB] United Kingdom ..... 8804319

[51] Int. Cl.[5] ..... E05C 9/04
[52] U.S. Cl. ..... 292/38; 292/336.3
[58] Field of Search ..... 292/125, 199, 225, 336.3, 292/141, 171, 142, 172, 38, 39; 74/89.22

[56] References Cited

U.S. PATENT DOCUMENTS 3,924,427 12/1975 San Juogin ..... 292/38 X
4,453,072 6/1984 Middleton, Jr. et al. ..... 74/89.22 X
4,476,700 10/1984 King ..... 292/39 X

FOREIGN PATENT DOCUMENTS 1425748 7/1969 Fed. Rep. of Germany ..... 74/89.22
2177150A 1/1987 United Kingdom ..... 292/39

*Primary Examiner*—Richard E. Moore
*Attorney, Agent, or Firm*—Leydig, Voit & Mayer

[57] ABSTRACT

An operating mechanism for an espagnolette fastening arrangement, particularly for a window frame of extruded sections, comprises a casing (21) within which are disposed two sliders (22, 23) and a toothed drive belt (24) entrained around rollers (25), opposite runs of the belt between the rollers engaging rack formations (27, 28) on the sliders. The sliders are connected to espagnolette bars (34, 39) and one of the sliders (23) is moveable by a cranked rod (18) operable by a handle (12). The use of the toothed belt as a means of driving the sliders in opposite directions simultaneously enables the mechanism to be of compact dimensions.

12 Claims, 5 Drawing Sheets

OPERATING MECHANISM FOR CLOSURE FASTENING ELEMENTS

BACKGROUND TO THE INVENTION

1. Field of the Invention

This invention relates generally to an operating mechanism for moving fastening elements of a closure such as a window, shutter or door simultaneously in opposite directions. The fastening elements, e.g. espagnolette bars, are provided at a frame member at one edge of the panel, and are required to be moved simultaneously in directions opposite to one another. Particularly, the invention relates to an operating mechanism interconnecting such fastening elements so that they are caused to undergo such opposite movement.

2. Review of the Prior Art

There have been many proposals hitherto for mechanisms for causing such opposite movement of two fastening elements such as espagnolette bars; for example, rack and pinion mechanisms wherein members connected to two espagnolette bars have rack formations and pinion is provided therebetween engaging both racks so that the members move together in opposite directions. A manually operable handle could be connected to the pinion. One problem in the design of such operating mechanisms is that they are generally bulky and difficult to accommodate in relation to a window frame member of modern extruded metal or plastics type, which is designed to be as slim and unobtrusive as possible.

To accommodate such a rack and pinion mechanism in a frame member would require the parts to be of very small size, and in particular the reduction in diameter of the pinion to the extent necessary would mean that it may not engage properly with the rack members.

SUMMARY OF THE INVENTION

According to the invention, there is provided an operating mechanism for moving fastening elements of a closure simultaneously in opposite directions comprising an endless toothed drive belt constrained for movement in a loop in which the drive belt provides two spaced runs, and two sliders arranged for sliding movement in respective paths parallel to and in driving engagement with respective runs of the drive belt, so that movement of one slider in one direction causes the drive belt to move in said loop to move the other slilder in a direction opposite to the direction of movement of said one slider.

A device according to the invention can be designed to be of very compact dimensions, and accommodated at any convenient point in a window or door frame. The casing of the device may be arranged to be mounted at least partially within a frame member. The device according to the invention has to be used, of course, with an appropriate mechanism for causing movement of one of the fastening elements which the device connects, but such mechanism may be disposed at a position on the frame member spaced from the device.

The following is a more detailed description of some embodiments of the invention by way of example, with reference to the accompanying drawings, of which:

DESCRIPTION OF THE PREFERRED EMBODIMENTS

Figure 1:
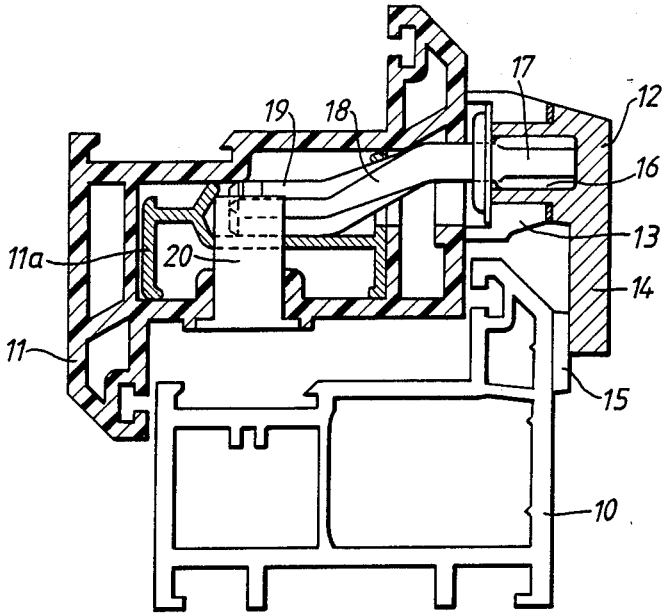
FIG. 1 is a transverse section through a frame of a window, having a first form of operating mechanism incorporated in an espagnolette operating mechanism.

Referring firstly to FIG. 1 of the drawings, there is shown in section a part 10 of the fixed peripheral frame of a pivotally opening sash window, and a part 11 of the openable sash frame. Both these frame members are extrusions of a plastics material, typically UPVC. The frame members, as is generally known, include formations to receive sealing elements, and the member 11 is shaped to receive a glass pane and glazing bead to retain the glass. The sash frame 11 is provided with a handle having a cockspur formation 14 engageable with a keeper 15 secured to the fixed frame 10 when the handle is one angular position, to hold the sash closed.

The handle 12 has a non-circular recess 16 receiving a flattened end portion 17 of a cranked rod 18 which extends into the hollow interior of the sash frame 11, the other end 19 of the cranked rod 18 being engageable with an operating member of a gearbox as described hereafter and indicated at 20 in FIG. 1. Also visible in FIG. 1 is a metal reinforcement 11*a* in the sash frame 11.

Figure 2:
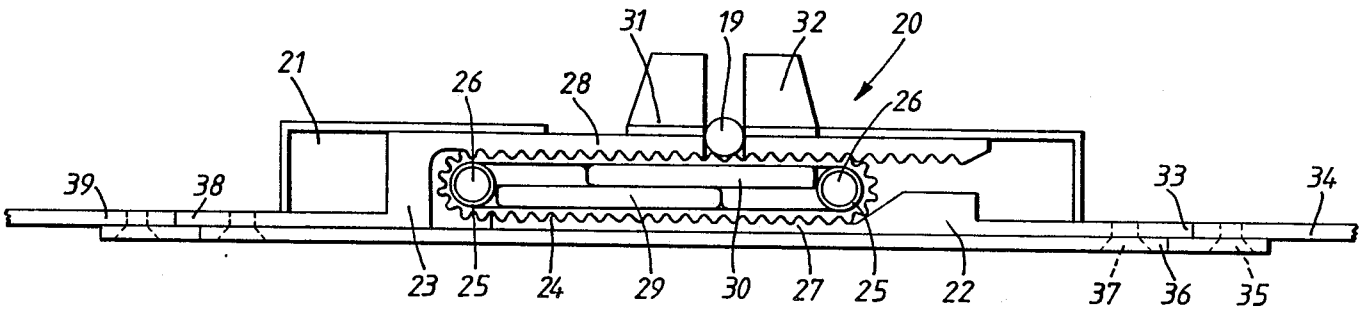
FIG. 2 is a longitudinal section through a part of the operating mechanism.

Referring now to FIG. 2 of the drawings, this shows in greater detail the gearbox 20. It comprises a casing 21 which extends lengthwise of the sash frame member 11. Within the casing are disposed two sliders 22, 23, able to slide within the casing in a direction lengthwise thereof and of the sash frame member. Also within the casing is a toothed drived belt 24 which is entrained around two rollers 25 on pins 26 spaced lengthwise of the casing 21. The belt 24 is arranged with its teeth on the outside of the loop it forms. Thus, the belt 24 forms a loop having two parallel but spaced runs (although these runs need not be parallel).

The sliders 22, 23 have respective toothed rack formations 27, 28 which extend lengthwise of the casing 21 and face one another, engaging with the teeth of the belt 24 on respective opposite runs of the belt between the rollers 24. The sliders 22, 23 are further provided with respective guide plate formations 29, 30 which are closely spaced from their rack formations 27, 28, so that the belt 24 is held firmly in engagement with the rack formations. Further, the guide plate formations 29, 30 abut one another back-to-back so that the sliders are effectively guided by the plates for their sliding movement within the casing 21.

The slider 23 is provided with spaced lugs 31, 32 between which the end 19 of cranked rod 18 is a close fit. Thus, angular movement of the handle 12 causes sliding movement of the slider 23 within the casing 21, and thus the opposite sliding movement of the slider 22 as above described. It will be appreciated that the above described arrangement ensures that the sliders simultaneously move in directions opposite to one another, through equal distances.

Slider 22 has a portion 33 which extends outside the casing 21, for attachment to an espagnolette bar 34 by a screw at 35. The casing has a flange portion 36 for receiving a fixing screw at 37 to hold it to the sash frame member 11, such screw passing through an elongate slot in the portion 33 of the slider which extends outside the casing. At the opposite end of the casing, slider 23 has a similar outwardly extending portion 38 for connection to an espagnolette bar 39.

Figure 3:
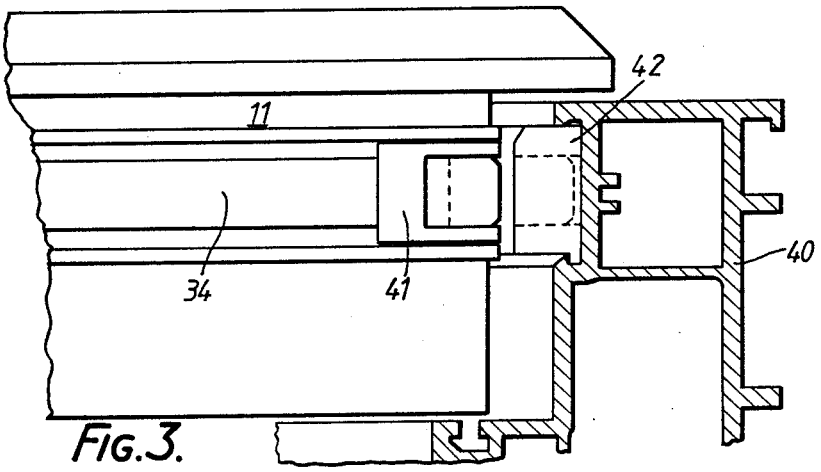
FIG. 3 shows diagrammatically, partly in section, a corner of the window frame and the operation of an espagnolette bar thereat.

The espagnolette bars 34, 39 extend in opposite directions from the mechanism 20 to the corners of the sash. The arrangement at one such corner is illustrated in FIG. 3, where there is visible the end of the sash frame member 11. At 40 is shown in section a member of the fixed peripheral frame which extends at right angles to the frame member 10 of FIG. 1. Espagnolette bar 34 extends to the end of the frame member 11, where it is guided by a guide member 41. A keeper 42 is fixed to the frame member 40, and the espagnolette bar 34 is movable between a retracted position where it is clear of the keeper 42 and an extended position, shown in broken lines, where it is engaged with the keeper 42. At the opposite end of frame member 11, the oppositely extending espagnolette bar 39 will similarly engage with a keeper on the fixed frame of the window.

Thus the arrangement described above with reference to the drawings provides a three-point fastening for the window sash, namely at the cockspur handle which will be provided generally in the centre of the sash frame, and by the espagnolette bars at opposite ends of such frame member.

Figure 4:
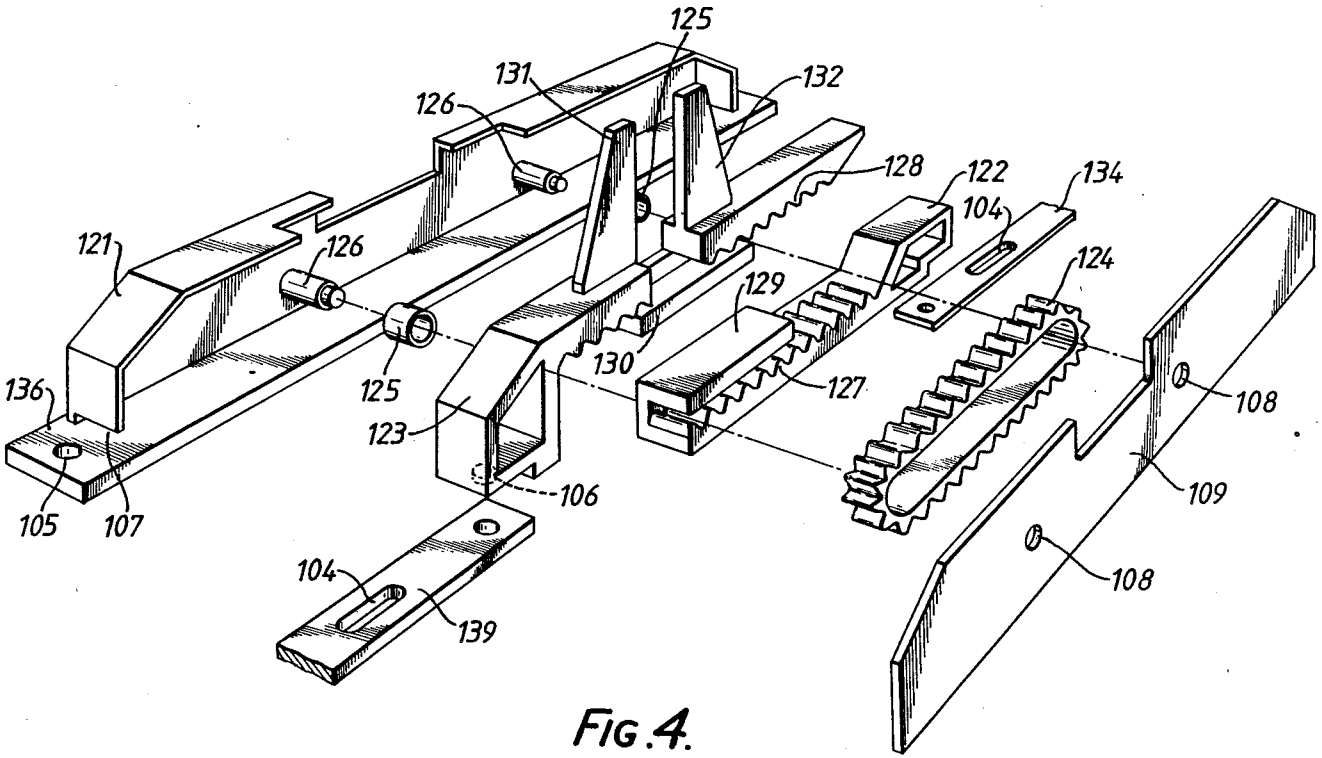
FIG. 4 is an exploded perspective view of a second embodiment of an operating mechanism incorporated in an espagnolette mechanism of the kind shown in FIG. 2.

Referring next to FIG. 4 of the drawings, this shows in exploded perspective view a slightly modified embodiment of the mechanism of FIG. 2. The same reference is numerals with the addition of 100 are used for corresponding parts. Thus, the mechanism comprises a casing 121 within which are reciprocable two sliders 122, 123. The sliders have rack formations 172, 128 which face one another, and guide plates 129, 130 spaced from the rack formations and engageable back-to-back. A toothed drive belt 124 is entrained around rollers 125 on pins 126, and engages the racks of the sliders in the manner of the embodiment of FIG. 2. Slider 123 has lugs 131, 132 between which an operating crank is engageable. Visible in FIG. 4 although not shown in FIG. 2 is a cover plate 109 which would be secured to the casing 121 by riveting over the ends of pins 126 extending through apertures 108 in the cover plate.

The embodiment of FIG. 4 differs from that of FIG. 2 in that, instead of the sliders having portions which extend outside the casing, the espagnolette bars 134, 139 extend into the casing through slots as 107. Within the casing, the espagnolette bars engage with pins as 106 on the sliders. Also shown in FIG. 4 is aperture 105 in mounting flange 136 at one end of the casing 121 (the aperture the other end of the casing not being visible), and slots 104 in the espagnolette bars 134, 139, through which screws for fixing the casing would extend.

Figure 5:
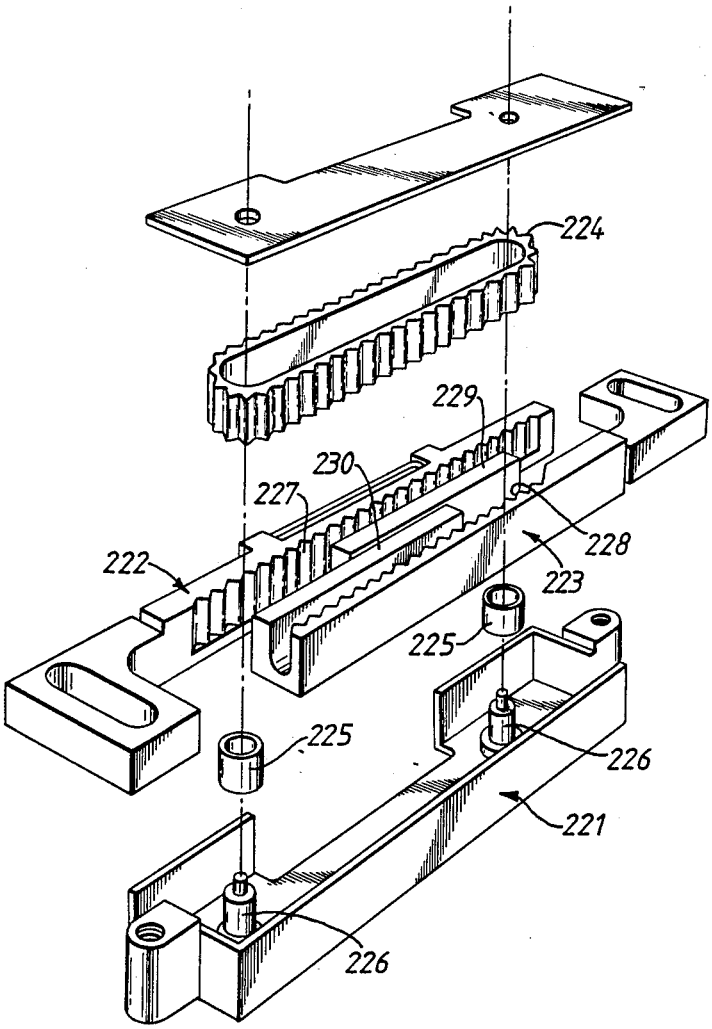
FIG. 5 is an exploded perspective view of a third embodiment of an operating mechanism incorporated in an espagnolette mechanism of the kind shown in FIG. 2.

Returning next to FIGS. 5, 7 and 8, the third embodiment is also incorporated in an espagnolette operating mechanism of the kind shown in FIGS. 1 to 4. The same reference numerals are used for corresponding parts with the addition of 200.

The third embodiment differs from the first and second embodiments by having the toothed drive belt 224 passing around rollers 225 on pins 226 whose axes lie in a plane normal to the axis of the handle 212.

The embodiment comprises (see FIG. 5) a gearbox 220 having a casing 221 within which are disposed two sliders 222, 223, able to slide within the casing in a direction lengthwise thereof. Also within the casing is the toothed drive belt 224 which passes around two rollers 225 on pins 226 spaced lengthwise of the casing 221. The belt 224 is arranged with its teeth on the outside of the loop it forms. The sliders 222, 223 have rack formations 227, 228 that face one another and engage respective opposite stretches of the belt 224, and have guide plates 229, 230 spaced from the rack formations 227, 228 and engageable back-to-back.

Figure 6:
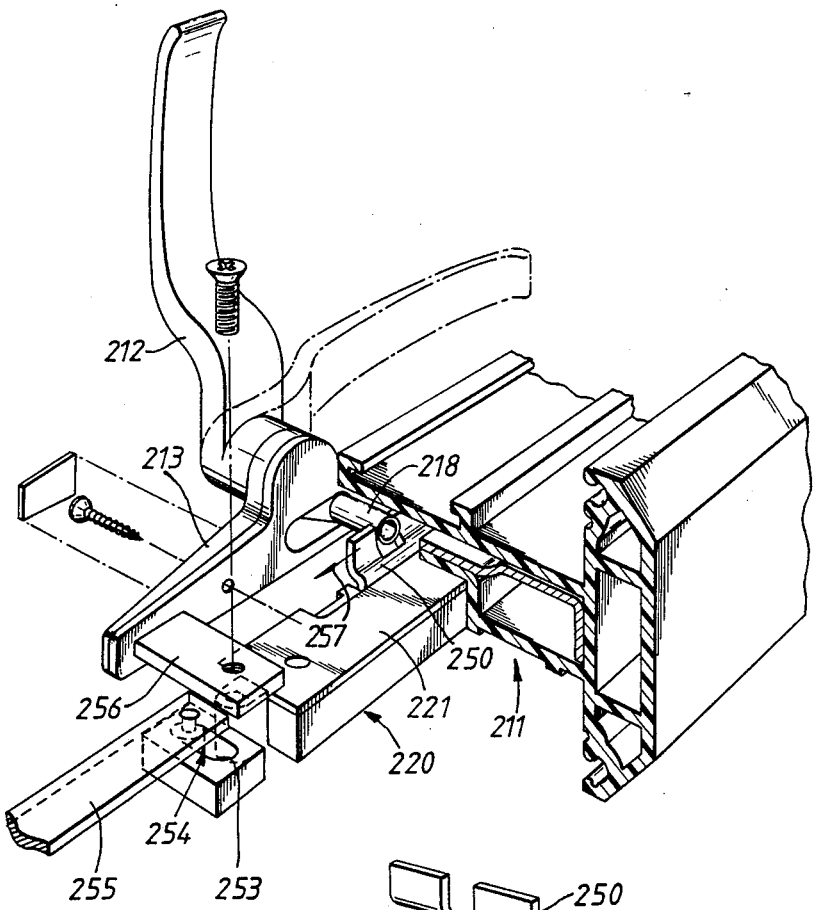
FIG. 6 is a view, partially in section, of an openable sash frame of a pivotally opening sash window including the operating mechanism of FIG. 5.
Figure 7:
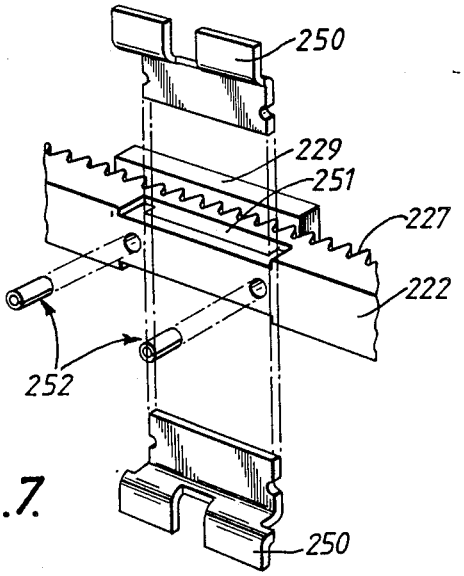
FIG. 7 is a view of a part of a slider of the mechanism of FIGS. 5 and 6 showing the possible orientations of a drive plate of the mechanism.

Referring now to FIGS. 6 and 7, the casing 221 is mounted in a part 211 of an openable sash frame which closes in to a fixed peripheral frame (not shown) of a pivotally opening sash window. The casing 221 is mounted with the belt 224 arranged horizontally as described above. The sash frame is provided with a handle 212 rotatable relative to a base plate 213 which is fixed to the casing 221 via projections 256. The handle 212 has a cranked rod 218 extending therefrom through the base plate 213. The end of the cranked rod 218 remote from the handle 212 engages a fork provided in a drive plate 250.

As best seen in FIG. 7, the drive plate 250 is received in a slot 251 provided in one, 222, of the sliders. The plate 250 is fixed to the slider 222 by pins 252. As shown, the slot 251 extends right through the slider 222 so that the plate 250 can project from either side of the slide 222 and the mechanism can be used with handles 212 that rotate in either sense.

The ends of the sliders 222, 223 extend outside the casing 221 and are provided with fixing slots 253 at their ends. These slots 253 receive respective pins 254 carried at the ends of drive bars 255 of a espagnolette mechanism of the kind described above with reference to the drawings.

Thus, rotation of the handle 212 from the full line position to the broken line position of FIG. 6, causes rotation of the cranked rod 218. Thus, in turn, causes movement of the drive plate 250 in the direction of the arrow 257 in FIG. 6. This moves the slider 222 to which it is fixed which in turn moves the belt 224 in its loop around the rollers 225 and pins 226. This causes movement of the second slider 223 in a direction opposite to the direction of movement of the first slider 222, so operating the espagnolette mechanism in one sense. Reverse rotation of the handle 212 will return the espagnolette mechanism to its original position.

The flexible toothed drive belt, 24, 124, 224, which as is well known is of an elastomeric material reinforced with metal or fabric cords, can be entrained around guide members of small diameter so that the two runs of the belt between the guide members are very close together. The belt can engaged with the rack formations on the sliders to give a far more positive and reliable drive thereof than could a pinion of comparably small diameter disposed between the sliders. The rack formations on the sliders face one another, and the belt is arranged with its teeth facing outwardly to engage the rack formations. The inside of the belt, having no teeth, will pass smoothly around guide members of small diameter. However, the arrangement could be oppositely disposed with the teeth of the belt facing inwardly and the racks facing inwardly.

Although in the above embodiments the slider 23, 123 or the plate 250 is engaged by a cranked rod moved by the handle 12, it will be appreciated that the gearbox assembly would be usable with other handle arrangements. For example, handle assemblies incorporating rack and pinion mechanisms are known, provided with a linearly movable output member for engagement with a single espagnolette bar. Such an output member could engage the lugs of slider 23, 123 or the plate 250, thereby to drive two espagnolette bars in opposite directions.

Further, the devices of FIGS. 1 to 7 may be used with any desired mechanism, which may be disposed at a point remote from the device, for moving any two locking members or lock operating members, in opposite directions. Such a mechanism may be used in any closure, such as a door, in which a leaf pivots into a fixed frame and is to be locked after closed by spaced locking members.

I claim:

1. An operating mechanism for moving fastening elements of a closure simultaneously in opposite directions comprising;

constraining means, an endless toothed drive belt arranged for movement in a loop around said constraining means, a first run of said endless toothed drive belt formed by said loop, a second run of said endless toothed drive belt formed by said loop, a first slider arranged for sliding movement in a path and engaging said first run of said endless toothed drive belt, a second slider arranged for sliding movement in a path parallel to the path of said first slider and engaging said second run of said endless toothed drive belt, operating means for moving said first slider in said path, said movement causing said endless toothed drive belt to move in said loop to move said second slider in said path in a direction opposite to the direction of movement of said one slider.

2. A mechanism according to claim 1 wherein the two sliders have toothed rack formations which extend therealong and which engage a substantial number of the teeth of the drive belt in the respective runs thereof.

3. A mechanism according to claim 2 wherein the slider are arranged to run in parallel paths.

4. A mechanism according to claim 1 wherein the sliders are further provided with formations for holding the belt in engagement with the sliders.

5. A mechanism according to claim 4 wherein said belt-holding formations are in sliding engagement with one another to assist in guiding the sliders in the movement thereof.

6. A mechanism according to claim 1 claims wherein said constraining means comprise spaced rollers.

7. A mechanism according to claim 1 wherein said operating means comprise a rotatable handle, a crank extending therefrom engaging said one slider for moving such slider on rotation of the handle.

8. A mechanism according to claim 7 wherein said one slider is provided with spaced lugs between which said crank engages.

9. A mechanism according to claim 7 wherein said one slider is provided with a plate that engages said crank, said plate being mountable on said one slider to project from one or other of the sides of the slider.

10. A mechanism according to claim 7 wherein said handle is arranged to be mounted on the exterior of a pivoted frame member of a window, with said crank extending into the interior thereof to engage said one slider.

11. A mechanism according to claim 7 wherein the handle is provided with a cockspur fastening formation.

12. A window frame having a frame member provided with a mechanism according to claim 1, and further comprising espagnolette bars connected to the sliders and extending lengthwise of the frame member from the operating mechanism to positions on the frame member spaced from the operating mechanism.

* * * * *